United States Patent [19]

Kiersz et al.

[11] Patent Number: 4,806,136

[45] Date of Patent: Feb. 21, 1989

[54] AIR SEPARATION METHOD WITH INTEGRATED GAS TURBINE

[75] Inventors: Donna F. Kiersz, Buffalo, N.Y.; Karen D. Parysek, Danbury, Conn.

[73] Assignee: Union Carbide Corporation, Danbury, Conn.

[21] Appl. No.: 133,429

[22] Filed: Dec. 15, 1987

[51] Int. Cl.[4] ..... F25J 3/00

[52] U.S. Cl. ..... 62/18; 55/74; 62/39; 62/44

[58] Field of Search ..... 62/18, 38, 39, 42, 43, 62/44; 55/74, 76

[56] References Cited

U.S. PATENT DOCUMENTS

| | | | |
|---|---|---|---|
| 3,731,495 | 5/1973 | Coveney | 62/39 |
| 3,854,913 | 12/1974 | Leyarovski et la. | 62/18 |
| 3,905,201 | 9/1975 | Coveney et al. | 62/18 |
| 4,224,045 | 8/1980 | Olszewski et al. | 62/30 |
| 4,400,188 | 8/1983 | Patel et al. | 62/39 |
| 4,451,275 | 5/1984 | Viles et al. | 62/39 |
| 4,557,735 | 12/1985 | Pike | 55/26 |

*Primary Examiner*—Ronald C. Capossela
*Attorney, Agent, or Firm*—Stanley Ktorides

[57] ABSTRACT

An air separation method employing compression powered by a gas turbine and employing four heat regenerable adsorbent purifiers wherein two purifiers are used to purify feed air while a third purifier is being regenerated by hot regeneration gas and a fourth purifier is being cooled so as to be ready to purify feed air.

23 Claims, 1 Drawing Sheet

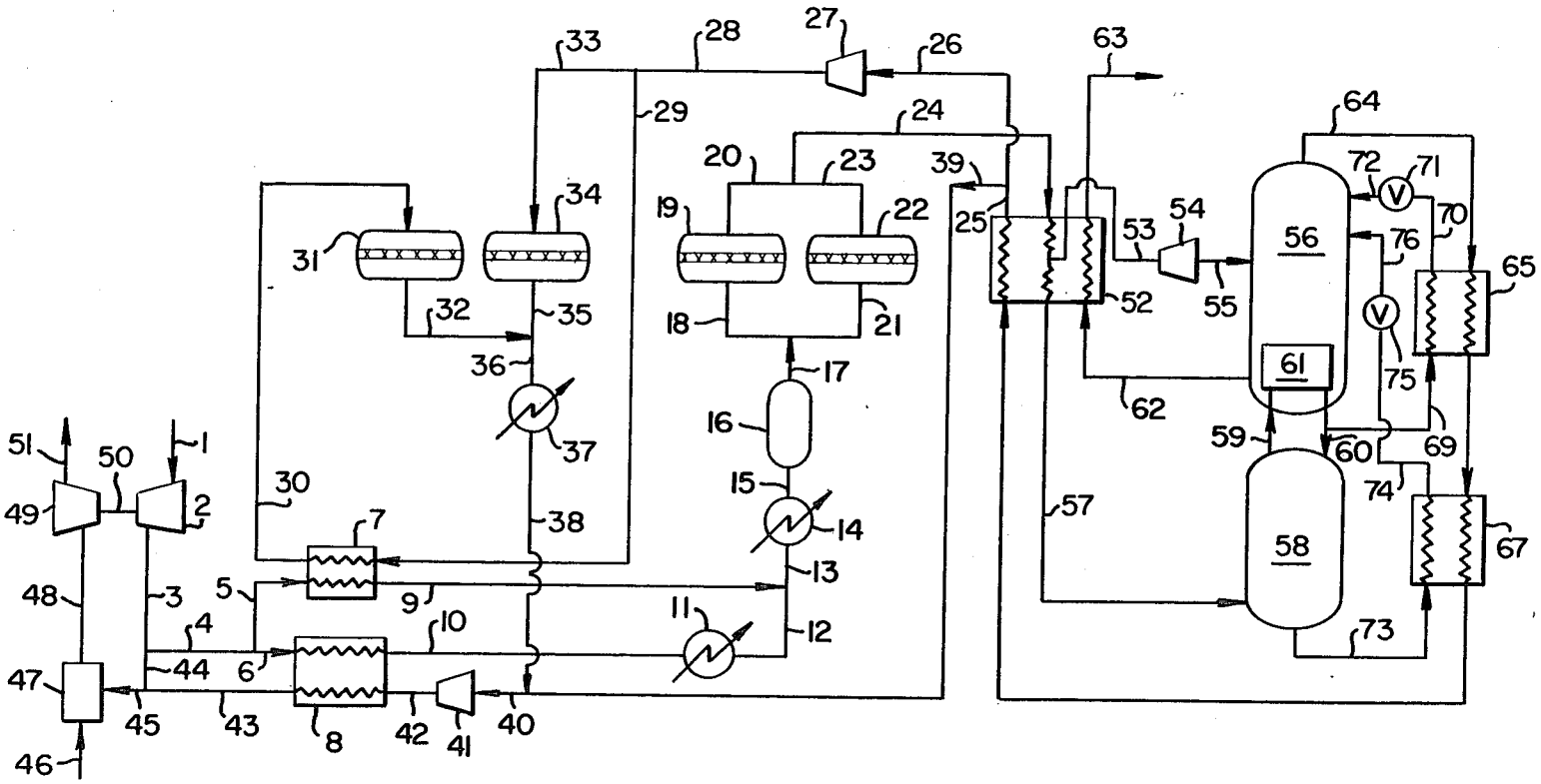
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55
56
57
58
59
60
61
62
63
64
65
67
69
70
71
72
73
74
75
76

AIR SEPARATION METHOD WITH INTEGRATED GAS TURBINE

TECHNICAL FIELD

This invention relates generally to the separation of air wherein a gas turbine is integrated into the method to provide power to compress the feed air, and more particularly to the purification of the feed air for such methods.

BACKGROUND ART

Atmospheric gases, such as oxygen, nitrogen and argon, are generally produced by the separation of air into its constituents. The energy to carry out this separation is generally provided in the form of elevated pressure by the compression of the feed air. One method of compressing the feed air is to pass it through a compressor driven by a gas turbine powered by expanding gas from the air separation. For example, U.S. Pat. No. 4,224,045 Olszewski, et al. discloses a system for reducing the compression energy required by integrating the air separation system with a gas turbine. A portion of the compressed air from the gas turbine air compressor is mixed with fuel and combusted. At some point prior to expansion, compressed nitrogen from the lower pressure column of a double column cryogenic air separation plant is added to the combustion mixture, and the resulting gaseous mixture is expanded in a power turbine. The expansion provides energy to compress the feed air to the double column air distillation process.

A method generally employed to purify feed air of high boiling impurities, such as water, carbon dioxide, and hydrocarbons, prior to separation in the air separation facility, employs the use of reversing heat exchangers wherein these impurities are frozen out of the feed air stream. However, the high operating pressures of integrated gas turbine air separation systems generally exceed the practical pressure limits of commercially available reversing heat exchangers. It is therefore desirable to use adsorbent bed prepurifiers for feed stream purification. U.S. Pat. No. 4,557,735-Pike teaches a method of employing such prepurifiers with integrated gas turbine air separation. This patent teaches cleaning the feed air in prepurifiers containing heat regenerable adsorbent, and regenerating the adsorbent with a portion of the waste nitrogen which has been preheated against hot compressed air from the gas turbine air compressor. However, the hot regeneration gas is required only on an intermittent basis. This leads to fluctuations within the process. When hot air is not required for heating the regeneration gas, the extra air flow must either be added to the main feed air waste nitrogen heat exchanger thus causing fluctuations in outlet temperature for both air and nitrogen, or it must be cooled in a separate heat exchanger against some medium such as cooling water thus adding to the capital requirements for the system. Furthermore, because regeneration gas is added to the main waste nitrogen stream prior to compression, temperature variations in the nitrogen compressor feed due to variations in regeneration gas temperature may cause operational problems with the nitrogen compressor.

It is therefore an object of this invention to provide an air separation method employing an integrated gas turbine and heat regenerable adsorbent purifiers wherein temperature and flow variations for feed air and return nitrogen streams are substantially reduced.

SUMMARY OF THE INVENTION

The above and other objects, which will become apparent to one skilled in the art upon a reading of this disclosure are attained by the present invention which is:

A method for purifying feed air for separation in an air separation facility comprising:

(a) compressing feed air;

(b) cooling the compressed feed air;

(c) passing a first portion of the cooled, compressed feed air through a first purifier containing heat regenerable adsorbent, and a second portion of the cooled, compressed feed air through a second purifier containing heat regenerable adsorbent, wherein the first and second portions are substantially cleaned of impurities by transfer of the impurities to the adsorbent;

(d) introducing the cleaned first and second portions into an air separation facility as feed air;

(e) separating the feed air in the air separation facility into nitrogen-rich and oxygen-rich components;

(f) warming a first part of the nitrogen-rich component;

(g) passing the warmed first part through a third purifier containing heat regenerable adsorbent which contains impurities so as to transfer those impurities to the warmed part and thus clean the adsorbent;

(h) passing a second part of the nitrogen rich component through a fourth purifier containing clean, warm, heat regenerable adsorbent to cool the adsorbent;

(i) expanding the resulting first and second parts through an expansion turbine for the production of external work; and (j) employing at least a portion of said external work to compress the feed air of step (a).

The term "air separation facility" is used herein to mean a plant to separate air into nitrogen-richer and oxygen richer components, such as a cryogenic air separation facility wherein cooled, cleaned, compressed feed air is separated by fractional distillation. Typical examples of a cryogenic air separation facility are a single column and a double column air separation plant.

The term "heat regenerable adsorbent" is used herein to mean an adsorbent which has a higher adsorption capacity at cooler temperatures so that the heating of impurity-laden adsorbent will cause the adsorbent to release impurities. A typical example of heat regenerable adsorbent is molecular sieve.

The term "column" is used herein to mean a distillation or fractionation column, i.e., a contacting column or zone were liquid and vapor phases are countercurrently contacted to effect separation of a fluid mixture as, for example, by contacting of the vapor and liquid phases on a series of vertically spaced trays or plates mounted within the column or, alternatively, on packing elements with which the column is filled. For an expanded discussion of fractionation columns see the Chemical Engineer's Handbook, Fifth Edition, edited by R. H. Perry and C. H. Chilton, McGraw Hill Book Company, New York Section 13, "Distillation" B. D. Smith et al. page 13-3, *The Continuous Distillation Process.*

The term, "double column", is used herein to mean a higher pressure column having its upper end in heat exchange relation with the lower end of a lower pressure column. An expanded discussion of double columns appears in *Ruheman* "The Separation of Gases" Oxford University Press, 1949, Chapter VII, Commercial Air Separation.

The term "impurities" is used herein to mean constituents of the feed air stream such as carbon dioxide, water and hydrocarbons such as acetylene, having a higher boiling point relative to the major components of air such as oxygen and nitrogen.

The term "indirect heat exchange" is used herein to mean the bringing of two fluid streams into heat exchange relation without any physical contact between the streams.

BRIEF DESCRIPTION OF THE DRAWING

The sole FIGURE is a schematic flow diagram of one preferred embodiment of the method of this invention wherein each of the first purifier, second purifier, third purifier and fourth purifier comprises a single adsorbent bed.

DETAILED DESCRIPTION

The method of this invention will be described in detail with reference to the FIGURE.

Referring now to the FIGURE, feed air is introduced through conduit 1 to compressor 2 wherein it is compressed to a desired pressure, preferably the design pressure of the gas turbine power system. The gas turbine pressure may be within the range of from about 85 to 600 pounds per square inch absolute (psia) and preferably exceeds 100 psia. The compressed air passes through conduit 3 and at least part of the feed air passes through conduit 4 for passage to the air separation plant. A portion of the air separation plant feed from conduit 4 passes through conduit 5 to heat exchanger 7 wherein it is cooled by indirect heat exchange with nitrogen rich gas from the air separation facility. The remaining part of the compressed feed air is passed through conduit 6 to heat exchanger 8, wherein it is cooled by indirect heat exchange with the nitrogen stream which is to be expanded.

Cooled air from heat exchanger 8 passes through conduit 10 to heat exchanger 11 wherein it is further cooled. Depending on the temperature of the air entering unit 11, it may be possible to recover heat from the compressed feed air by generating steam or heating boiler feed water. The further cooled air from unit 11 passes through conduit 12 and is combined with the cooled air from heat exchanger 7 and the combined stream is then passed through conduit 13 to heat removal unit 14. The further cooled, compressed feed air in conduit 15 may be cooled further in chiller 16. The feed air is cooled to below ambient temperature and preferably to about 40° F., before being introduced to the purifiers.

Compressed, cooled feed air 17 is divided into first portion 18 and second portion 21. First portion 18 is passed through first purifier 19 and second portion 21 is passed through second purifier 22. Feed air stream 17 is preferably equally divided among the beds removing impurities from the feed air. Thus for the case where each of the first and second purifiers comprise a single bed, such as illustrated in the FIGURE, streams 18 and 21 are each preferably about 50 percent of feed air stream 17.

Each of purifiers 19 and 22 contains heat regenerable adsorbent. Any heat regenerable adsorbent which is capable of removing impurities from the feed air may be used with the method of this invention. The preferred heat regenerable adsorbent is molecular sieve, although composite beds of alumina and molecular sieve can be acceptable. By passage through the first and second purifiers respectively, the first and second portions are substantially cleaned of impurities by transfer of the impurities to the adsorbent.

The compressed, cooled, and cleaned first and second portions then pass out of purifiers 19 and 22 in conduits 20 and 23 respectively and are combined to form stream 24 which is conducted through heat exchanger 52. Heat exchanger 52 serves to further cool the feed air by indirect heat exchange with return streams from the air separation facility including nitrogen rich gas. The embodiment of the FIGURE illustrates the preferred arrangement wherein the air separation facility is a cryogenic double column air separation plant.

A portion of the compressed, cleaned, cool feed air in conduit 24 is removed from heat exchanger 52 in conduit 53 before it is cooled to the final outlet temperature of the main feed air stream in conduit 57. Refrigeration for the air separation plant is produced by expanding the air stream in conduit 53 through expansion turbine 54, which typically recovers the energy of expansion as useful work. The expanded air in conduit 55 is introduced into column 56 wherein it is separated by cryogenic rectification into nitrogen-rich and oxygen-rich components.

The main feed air stream in conduit 57 is introduced into column 58 wherein it is separated by cryogenic rectification into nitrogen-rich gas and oxygen-enriched liquid. The nitrogen-rich gas is passed in conduit 59 to condenser 61 wherein it is condensed and is returned by conduit 60 to column 58 as liquid reflux. The oxygen-enriched liquid is removed from column 58 through conduit 73. The embodiment of the FIGURE is a preferred embodiment wherein column 58 is in heat exchange relation by condenser 61 with column 56 which is operating at a pressure less than that of column 58. For example, in such a double column arrangement the higher pressure column 58 may operate at a pressure within the range of from about 80 to 493 psia, preferably within the range of from 80 to 450 psia, while the lower pressure column 56 operates at a pressure below that of column 58. In this double column arrangement, the oxygen-enriched liquid is further separated in lower pressure column 56 into oxygen-rich gas and lower pressure nitrogen-rich gas. The oxygen enriched liquid 73 from column 58 is preferably cooled by passage through heat exchanger 67 by indirect heat exchange with outgoing lower pressure nitrogen rich gas and passed through conduit 74, expansion valve 75, conduit 76 and into column 56. In column 56 the liquid bottoms are reboiled by heat exchange with the condensing nitrogen rich gas 59. Preferably some of the condensed nitrogen-rich fluid is passed to lower pressure column 56 for use as reflux by passage through conduit 69, cooling by indirect heat exchange with lower pressure nitrogen-rich gas in heat exchanger 65 and passage through conduit 70, expansion valve 71, and conduit 72 and then introduction into column 56. Oxygen product having a purity of from 90 to 99.5 percent may, if desired, be recovered. In the preferred embodiment of the FIGURE, oxygen product is removed from column 56 through conduit 62, warmed by passage through heat exchanger 52 and recovered as stream 63.

The lower pressure nitrogen-rich gas is removed from the lower pressure column 56 through conduit 64 and warmed by passage through heat exchangers 65 and 67 and 52 from which it emerges as stream 25 comprising nitrogen-rich component from the air separation facility.

Stream 26 comprises nitrogen-rich component for passage through the purifiers and preferably comprises an amount within the range of from 5 to 20 percent, most preferably from 7 to 12 percent of the feed air flow to the air separation facility, which in the embodiment illustrated in the FIGURE, is the combined air flow in streams 55 and 57. Stream 26 is taken from stream 25 and is compressed in blower 27 to a pressure above its initial pressure by at least an amount equal to the pressure drop through the adsorbent beds. This pressure drop is generally less than 10 pounds per square inch (psi). Alternatively, nitrogen-rich gas from higher pressure column 58 may be used as the nitrogen-rich component for regeneration purposes, thus eliminating the requirement for a regeneration gas blower. The nitrogen rich component is divided into two parts. The first part is warmed and passed to a third purifier and the second part is passed to a fourth purifier. In the embodiment illustrated in the FIGURE, nitrogen rich component 28 from blower 27 is divided into first part 29 and second part 33. First part 29 is passed to heat exchanger 7 wherein it is warmed by indirect heat heat exchange with cooling feed air. Thereafter warmed first part 30 is passed to purifier 31 which contains heat regenerable adsorbent containing impurities which were deposited thereon by transfer from feed air during a previous cycle. Warmed nitrogen-rich first part 30 passes through third purifier 31 and in the process these deposited impurities are transferred from the adsorbent to the nitrogen rich first part, thus serving to regenerate the adsorbent in purifier 31 for the next cycle. Thus the heat of compression of the feed air, which was transferred to the nitrogen-rich portion, is efficiently employed to heat and thus regenerate the adsorbent in purifier 31. The heated adsorbent releases the impurities which are swept up into the flow of the nitrogen-rich first part. The now impurity-containing nitrogen-rich first part emerges from purifier 31 as stream 32.

Second nitrogen rich part 33 is passed to fourth purifier 34. Fourth purifier 34 contains warm adsorbent which in a previous cycle was cleaned and warmed by passage of warm nitrogen rich gas through it. By passage through fourth purifier 34, second nitrogen-rich part 33 cools the adsorbent and thus places the adsorbent in condition for removing impurities from feed air. The second nitrogen-rich part emerges from purifier 34 and is combined with stream 32 to form stream 36. Impurity-containing stream 36 may be passed through heat removal unit 37 to recover useful heat and/or to improve the efficiency of compressor 41.

The impurity-containing nitrogen-rich stream, comprising the resulting first and second parts from the third and fourth purifiers respectively, is expanded by passage through an expansion turbine to produce work, at least a portion of which is employed to compress the feed air. The embodiment illustrated in the FIGURE is a preferred embodiment wherein additional nitrogen-rich component is employed, along with combustion gases, in the expansion turbine.

Referring back to the FIGURE, cooled, impurity-containing nitrogen-rich stream 38 is combined with lower pressure nitrogen-rich stream 39 taken from stream 25 to produce combined stream 40. This combined stream may then pass through compressor 41 which compresses the stream to a preferred pressure level to more efficiently employ the nitrogen-rich stream in the gas turbine system. Compressed impurity-containing nitrogen stream 42 is heated by indirect heat exchange in heat exchanger 8 with cooling feed air. The warm, compressed impurity-containing nitrogen stream 43 is then passed to power turbine 49 wherein it is expanded to produce external work and from which it emerges as stream 51. At least some of the work obtained from power turbine 49 is used to drive compressor 2 to compress the feed air. Compressor 2 may be directly connected to turbine 49 by shaft 50 as shown in the FIGURE. Alternatively, work may be transferred from turbine 49 to compressor 2 by a system of gears, or turbine 49 could drive an electrical generator which supplies electric energy to an electric motor to drive compressor 2. Any means of transferring work from turbine 49 to compressor 2 may be employed with the method of this invention. Some of the work obtained from power turbine 49 may also be used to drive nitrogen compressor 41.

The FIGURE illustrates a particularly preferred embodiment wherein a combustion gas powered gas turbine system is combined with an air separation facility. In this preferred embodiment, some of the air compressed in compressor 2 is passed through conduits 44 and 45 to combustion chamber 47 wherein it is mixed with fuel introduced through conduit 46 and ignited. The impurity-containing nitrogen-rich stream enters the combustion chamber combined with the air. The combustion products and impurity-containing nitrogen-rich gas then pass to power turbine 49 through conduit 48. The pressure in combustion chamber 47 at ignition is preferably at least 80 psia or greater. When this combustion chamber embodiment is employed, further energy may be recovered from the gases exiting power turbine 49 in conduit 51.

After operation for some period of time with first and second purifiers 19 and 22 cleaning the feed air, while third purifier 31 is being cleaned by the warm nitrogen-rich first part and fourth purifier 34 is being cooled by the cool nitrogen-rich second part, the purifiers are cycled so that purifier 19 continues to clean part of the feed as the second purifier, impurity-laden purifier 22 is cleaned by the warm nitrogen-rich first part as the third purifier, warm purifier 31 is cooled by the cool nitrogen-rich second part as the fourth purifier and formerly dirty, now clean and cooled purifier 34 cleans the remainder of the feed air as the first purifier. The purifiers continue to periodically cycle through the sequence of adsorption, warm regeneration, and cooling. The period of time between switches will vary depending on the concentration of impurities in the feed air, the feed air flow rate, and the size and type of purifier bed. Generally this period of time will be within in the range of from about 2 to 10 hours. In actual practice the flow changes among the purifiers would be made by an appropriate arrangement of valves. During depressurization and repressurization of the beds there may be times when the warm and cool nitrogen-rich parts are not required to pass through any of the purifier beds. In these cases the nitrogen-rich parts may be by-passed around the beds directly to heat recovery unit 37 to allow continued uniform operation.

The switching is carried out from bed to bed. Thus, the switching described above with respect to the embodiment illustrated in the FIGURE applies where each of the purifiers comprises a single bed.

The method of this invention employing four purifiers, two to clean incoming feed air, one to undergo warming regeneration, and another to undergo cooling, enables periodic switching so that variations in the temperature, flowrate and composition of nitrogen-rich streams from the air separation facility, and variations in the temperature of the compressed feed air do not cause excessive rerouting of hot regeneration gas. Thus heat energy is more uniformly employed and thus more efficiently employed to regenerate the impurity-containing purifier.

As previously mentioned, one may recover oxygen-rich component as oxygen product. In addition some of the nitrogen-rich component may be recovered as nitrogen product having a purity of 95 percent or more. For example, some nitrogen gas product could be recovered from stream 59 and/or some nitrogen liquid product could be recovered from stream 60.

Table 1 provides a tabular summary of a computer simulation of the method of this invention carried out in accord with the embodiment illustrated in the FIGURE. It is provided for illustrative purposes and is not intended to be limiting. The stream numbers refer to the stream numbers of the FIGURE.

TABLE 1

| Stream | Flow Rate (1000 $Ft^3$/hr @ 70° F. & 14.7 psia) | Pressure (psia) | Temperature (°F.) | Oxygen Content (mole %) |
|---|---|---|---|---|
| 4 | 10202 | 206 | 717 | 21 |
| 5 | 282 | 206 | 717 | 21 |
| 6 | 9920 | 206 | 717 | 21 |
| 9 | 280 | 204 | 83 | 21 |
| 10 | 9920 | 204 | 323 | 21 |
| 12 | 9885 | 203.5 | 113 | 21 |
| 13 | 10165 | 203.5 | 112 | 21 |
| 15 | 10119 | 203 | 75 | 21 |
| 17 | 10104 | 202 | 40 | 21 |
| 18 | 5052 | 202 | 40 | 21 |
| 20 | 5047 | 199 | 40 | 21 |
| 21 | 5052 | 202 | 40 | 21 |
| 23 | 5047 | 199 | 40 | 21 |
| 24 | 10094 | 199 | 40 | 21 |
| 25 | 7974 | 59 | 37 | 1.3 |
| 26 | 757 | 58 | 37 | 1.3 |
| 28 | 757 | 67 | 67 | 1.3 |
| 29 | 341 | 66.5 | 67 | 1.3 |
| 30 | 341 | 62.5 | 600 | 1.3 |
| 33 | 416 | 66.5 | 67 | 1.3 |
| 36 | 766 | 60.5 | 290 | 1.3 |
| 38 | 766 | 59 | 75 | 1.3 |
| 39 | 7217 | 59 | 37 | 1.3 |
| 40 | 7982 | 58.5 | 40.5 | 1.3 |
| 42 | 7982 | 210.5 | 210 | 1.3 |
| 43 | 7982 | 206 | 707 | 1.3 |
| 63 | 2121 | 62 | 37 | 95 |

Now, by the use of the method of this invention, one can improve the efficiency of an integrated gas turbine air separation method using heat regenerable adsorbent purifiers significantly increasing the useful effect of the hot regeneration stream. With the method of this invention, one may more regularly employ the hot regeneration gas for regenerating impurity-containing adsorbent even through relatively wide variations in temperature and flowrate of the air and nitrogen heat exchange streams.

Although the method of this invention has been described in detail with reference to one preferred embodiment wherein each of the four purifiers comprises a single adsorbent bed, those skilled in the art will recognize that there are other embodiments of the invention within the spirit and scope of the claims. For example, any one or more of the first purifier, second purifier, third purifier and fourth purifier may comprise more than one adsorbent bed.

We claim:

1. A method for purifying feed air for separation in an air separation facility comprising:

(a) compressing feed air;

(b) cooling the compressed feed air;

(c) passing a first portion of the cooled, compressed feed air through a first purifier containing heat regenerable adsorbent, and a second portion of the cooled, compressed feed air through a second purifier containing heat regenerable adsorbent, wherein the first and second portions are substantially cleaned of impurities by transfer of the impurities to the adsorbent;

(d) introducing the cleaned first and second portions into an air separation facility as feed air;

(e) separating the feed air in the air separation facility into nitrogen-rich and oxygen-rich components;

(f) warming a first part of the nitrogen-rich component;

(g) passing the warmed first part through a third purifier containing heat regenerable adsorbent which contains impurities so as to transfer those impurities to the warmed part and thus clean the adsorbent;

(h) passing a second part of the nitrogen-rich component through a fourth purifier containing clean, warm, heat regenerable adsorbent to cool the adsorbent;

(i) expanding the resulting first and second parts through an expansion turbine for the production of external work; and (j) employing at least a portion of said external work to compress the feed air of step (a).

2. The method of claim 1 wherein the heat regenerable adsorbent is molecular sieve.

3. The method of claim 1 wherein the feed air is compressed to a pressure within the range of from about 85 to 600 psia.

4. The method of claim 1 wherein the air separation facility is a cryogenic air separation facility.

5. The method of claim 4 wherein the cryogenic air separation facility is a double column air separation plant.

6. The method of claim 5 wherein the first and second parts of the nitrogen-rich component are taken from the lower pressure column and are compressed prior to their respective passage through the third and fourth purifiers.

7. The method of claim 1 wherein the first part of the nitrogen-rich component is warmed by indirect heat exchange with at least a portion of the cooling, compressed feed air of step (b).

8. The method of claim 1 wherein the first and second parts of the nitrogen-rich component are combined prior to the expansion of step (i).

9. The method of claim 1 wherein the first and second parts of the nitrogen-rich component are compressed prior to the expansion of step (i).

10. The method of claim 9 wherein the first and second parts of the nitrogen-rich component are cooled prior to said compression.

11. The method of claim 1 wherein the first and second parts of the nitrogen-rich component are heated by indirect heat exchange with at least a portion of the cooling, compressed feed air of step (b) prior to the expansion of step (i).

12. The method of claim 1 wherein a third part of the nitrogen-rich component is combined with the first and second parts of the nitrogen-rich component prior to the expansion of step (i).

13. The method of claim 1 further comprising mixing oxidant and fuel in a combustion zone, combusting the mixture at pressure and expanding the resulting combustion gases through the expansion turbine.

14. The method of claim 13 wherein the oxidant is a portion of the air compressed in step (a).

15. The method of claim 13 wherein at least a portion of the first and second parts of the nitrogen-rich component is provided to the combustion zone and then to the expansion turbine.

16. The method of claim 1 wherein the first and second parts of the nitrogen-rich component comprise an amount within the range of from 5 to 20 percent of the amount of feed air introduced into the air separation facility.

17. The method of claim 1 wherein the first and second parts of the nitrogen-rich component comprise an amount within the range of from 7 to 12 percent of the amount of the feed air introduced into the air separation facility.

18. The method of claim 1 wherein some of the nitrogen-rich component is recovered from the air separation facility as product nitrogen.

19. The method of claim 1 wherein at least some of the oxygen-rich component is recovered from the air separation facility as product oxygen.

20. The method of claim 1 wherein each of the first purifier, second purifier, third purifier and fourth purifier comprises a single adsorbent bed.

21. The method of claim 20 further comprising periodically cycling the four purifiers so that during the next cyclical period (1) the previous first purifier containing some impurities now cleans feed air as the second purifier, (2) the previous second purifier containing impurities is now regenerated as the third purifier, (3) the previous third purifier containing clean but warm adsorbent is now cooled as the fourth purifier, and (4) the previous fourth purifier containing cleaned and cooled adsorbent now cleans feed air as the first purifier.

22. The method of claim 21 wherein the cycle period is within the range of from 2 to 10 hours.

23. The method of claim 1 wherein one or more of the first purifier, second purifier, third purifier and fourth purifier comprises more than one adsorbent bed.

* * * * *